US005878875A

United States Patent [19]

Leong

[11] Patent Number: 5,878,875

[45] Date of Patent: Mar. 9, 1999

[54] CIGARETTE BOX INCORPORATING A MATCH DRAWER

[76] Inventor: Henry Leong, 1119 N. Oak Park, Oak Park, Ill. 60302

[21] Appl. No.: 850,919

[22] Filed: May 2, 1997

[51] Int. Cl.[6] ..... A24F 15/00

[52] U.S. Cl. ..... 206/86; 206/91; 206/268

[58] Field of Search ..... 206/86, 90, 91, 206/94, 268, 271, 273

[56] References Cited

U.S. PATENT DOCUMENTS

| | | | |
|---|---|---|---|
| 2,811,247 | 10/1957 | Stevenson | 206/86 |
| 3,915,295 | 10/1975 | Morrison | 206/86 |
| 4,015,769 | 4/1977 | Erlich | 229/44 |
| 4,046,252 | 9/1977 | Korby | 206/95 |
| 4,193,534 | 3/1980 | Focke et al. | 206/268 |
| 4,836,366 | 6/1989 | Mikhail | 206/94 |
| 4,887,711 | 12/1989 | Bladt | 206/92 |
| 4,989,728 | 2/1991 | Neyret | 206/91 |
| 5,096,057 | 3/1992 | Yoo | 206/90 |
| 5,482,157 | 1/1996 | Kim | 206/86 |
| 5,575,386 | 11/1996 | Focke et al. | 206/268 |

FOREIGN PATENT DOCUMENTS

| | | | |
|---|---|---|---|
| 654837 | 6/1963 | Italy | 206/91 |
| WO 94/01008 | 1/1994 | WIPO | 206/91 |

*Primary Examiner*—David T. Fidei
*Attorney, Agent, or Firm*—Michael, Best & Friedrich; Robert S. Beiser

[57] ABSTRACT

A cigarette container having a unitary, integral outer envelope utilizes a series of folds within discreet folding domains to form a lower cigarette containing portion and an upper flip top portion containing a match drawer cavity. A conventional inner insert is glued to the inner surface of the outer envelope to retain the cigarettes firmly but permit easy access thereto. A rectangular drawer for housing stick-type matches is provided which can be accessed from either side of the cigarette container. A striker surface is coated on one or more sides of the drawer as a convenience to left and right handed smokers.

3 Claims, 3 Drawing Sheets

CIGARETTE BOX INCORPORATING A MATCH DRAWER

BACKGROUND OF THE INVENTION

Cigarettes are typically packaged in soft or hard box type containers having lots of twenty cigarettes in each container. It is generally necessary for the user to separately carry matches or a mechanical cigarette lighter. The user is put to inconvenience if he has neglected to carry matches or a lighter at the time consumption of a cigarette is desired.

There have been several suggestions for combining matches in a cigarette container to provide a self-contained complete smoking product. U.S. Pat. No. 4,962,850 discloses a cigarette container in the form of a flip top box having a pair of spaced flaps to which are attached a plurality of book type matches. A disadvantage to this design is that it necessary to strike the match with the flip top open, thereby creating a hazard of inadvertently igniting the rest of the matches and the stock of cigarettes.

U.S. Pat. Nos. 4,046,252 and 4,836,366 followed a different approach and provide an attachment means or a strip housing for affixing a pack of book matches to the exterior of a cigarette container. The cigarette can be lit without fire hazard; however, the uneven and nonconventional thickness of the container makes it impossible to manufacture in an integral piece and creates problems in adapting the container to standard vending machines. U.S. Pat. Nos. 4,015,769 and 4,887,771 depart even further from conventional cigarette container construction in that the overall size, dimensions, number and orientation of folding steps, are not amenable to high speed, fully automated, and standardized packaging equipment.

In U.S. Pat. No. 4,989,728 a cigarette container is disclosed having an inner and outer envelope forming at the base, a compartment with an opening into which may be reversibly and removably inserted a drawer suitable for containing individual matches. The container has the advantage of having uniform dimensions, safety of use, and simplicity of construction. It has the disadvantages of opening only on one side, and requiring a wasteful duplication of construction material forming the walls of both inner and outer envelopes extending well over 50 percent of the surface of the container.

SUMMARY OF THE INVENTION

Analysis of the construction of several commercially produced flip top cigarette containers reveals that all or most of the significant brands utilize a common generic construction. This facilitates high speed, highly automated production of extremely large quantities of containers. It is therefore an object of the present invention, in constructing a cigarette container incorporating a match drawer, to alter the generic design of the industry standard as little as possible, so that retooling of existing fabricating equipment will be minimized.

It is a further object of the invention to provide a cigarette container incorporating a match drawer, of integral construction not requiring assembly of a separate piece, nor requiring any attachment means external to the cigarette container itself, which would alter the standard cigarette container dimensions.

It is a yet further object to provide a cigarette container incorporating a match drawer which requires minimal additional construction materials, and therefore minimizes additional materials expense.

According to the present invention, a cigarette container having a four sided outer envelope portion, an inner liner insert, and a flip top lid having reinforcement tabs, is modified to include a match drawer open ended at both sides of the cigarette container, disposed in the flip top lid in a cavity defined by extension of the posterior wall of the outer envelope to the height of drawer cavity, extension of reinforcement tabs and the front surface of the flip top lid by a commensurate distance, so that when folded in reinforcement position, the tabs join to form the floor portion of the drawer cavity, the extended portions of the flip top lid and the posterior wall of the outer envelope form the vertical walls of the drawer cavity, and the top surface of the flip top lid forms the upper wall of the drawer cavity.

In another aspect, the lower flip top lid portion comprises a pair of lower trapezoidal lateral flaps having outer surfaces and a back panel interposed therebetween, and a pair of trapezoidal lateral front flaps planarly vertical to the match drawer cavity whose inner surfaces engage the outer surfaces of the lower trapezoidal lateral flaps to form an integral flip top lid having a match drawer cavity at the top.

The cigarette container of the present invention can alternatively be defined in terms of its folding domains, since its major elements are contained within a unitary, hinged construct having a four sided outer envelope portion, an inner liner insert, and a flip top lid portion comprising an outer envelope of integral construction forming both a lower cigarette containing portion, and an upper flip top portion including a match drawer cavity, the integral envelope comprising folding domains in which horizontal and vertical folds define the folding domains.

This construct is defined by two major folding domains, the first folding domain characterized in having a pair of lateral flaps and a front panel portion disposed therebetween, the lateral flaps being capable of folding forwardly at right angles to the front panel in a vertical orientation, a bottom panel reinforced by lateral reinforcement tabs in a horizontal folding orientation to the front panel, and capable of folding at right angles, a back panel having two lateral trapezoidal flaps disposed to the left and right thereof and capable of folding vertically at right angles, the folded structure of said first folding domain forming the cigarette containing portion of the container.

A second folding domain is characterized in having a horizontal hinge fold connecting the cigarette containing folding domain and the upper flip top portion, lateral trapezoidal flaps disposed laterally to an elongated flip top back portion, the trapezoidal flaps being separated at a pair of horizontal folds into a lower trapezoidal lip portion and an upper reinforcement tab portion capable of folding horizontally downward at right angles, and simultaneously outward vertically at right angles to form a floor portion of the match drawer cavity, the elongated back portion capable of folding forward at right angles to form the top of the flip top and roof portion of said drawer cavity, and a further elongated segment extending downward from a horizontal fold terminating in an end portion of said front panel having lateral trapezoidal flaps, whose inner surfaces meet in mating engagement with the outer trapezoidal surfaces of the lateral trapezoidal flaps disposed lateral to the elongated flip top back portion.

An open topped drawer, sized to fit snugly within the drawer cavity contains a plurality of individual matches, which can be readily accessed by sliding the match drawer in either lateral direction to expose the open topped drawer contents.

DETAILED DESCRIPTION OF THE PREFERRED EMBODIMENT

Figure 1:
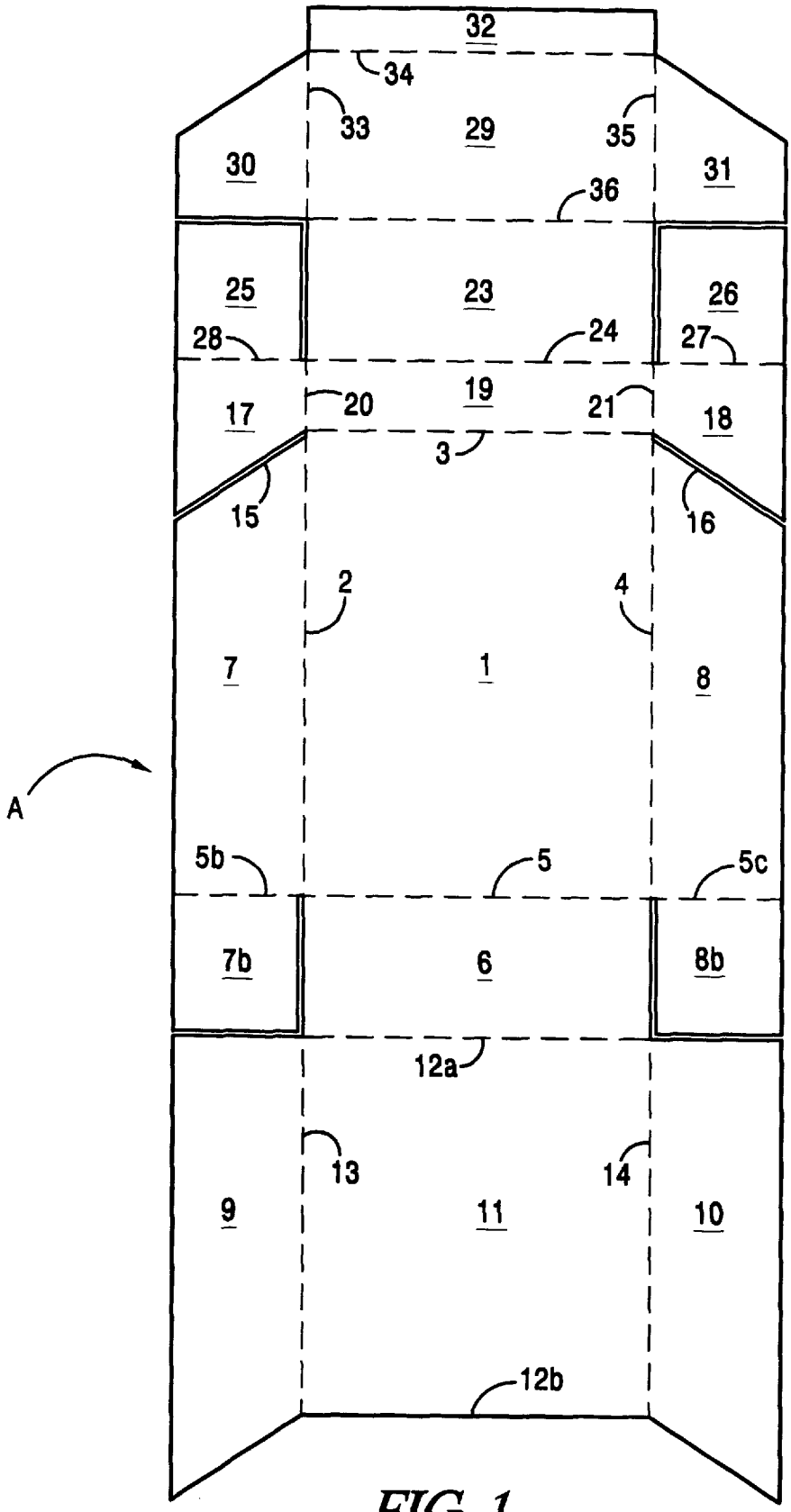
FIG. 1 is a plan view of a blank for an outer envelope portion of the cigarette container according to the generic standard of the cigarette industry.

FIG. 1 shows a plan view of the outer envelope of a generic cigarette container, commonly used in the tobacco industry. To determine an industry wide standard, cigarette containers from three commercially available well-known brands were obtained and subjected to design analysis, by dissecting the glued portions of the containers, arranging them in planar configuration, and reproducing the template as FIG. 1. The brands selected were Virginia Slims (Benson & Hedges), Merit Filter (Philip Morris), and Camel Lights (R. J. Reynolds) in the box flip top packaging format. All templates were of identical configuration. In the plan views of FIGS. 1–3, the solid lines represent cut edges, and the dotted lines represent folds in the container of heavy paper or cardboard construction. Open panels defined by solid or dotted lines indicate a generic or conventional structure; shaded panels defined by solid or dotted lines indicate a unique structure of the present invention.

The outer envelope A of FIG. 1 is generally divided into a lower cigarette holding portion including a rear panel 1 defined by the folds 2, 3, and 4; and an upper flip top portion. To the left and right of the rear panel 1 are two rear lateral flaps 7 and 8 defined by folds 2, 5, and 28; and folds 4, 5, and 27 respectively. The lower cigarette holding portion further includes a front panel 11 defined by the lower boundary of the material, and by folds 12, 13, 14. Laterally the folds 13 and 14 define the junction between front panel 11 and the frontal lateral flaps 9 and 10 respectively.

The upper flip top portion has a hinge 3 that connects at the rear of the container the flip top portion from the lower cigarette holding portion. Trapezoidal side flaps 17 and 18 are connected to a flip top back panel 19 at folds 20 and 21. The reinforcement tabs 25 and 28 are elongations of trapezoidal flaps 17 and 18 respectively, and are connected vertically at folds 28 and 27. The flip top portion further includes a top panel 23 and a front panel 29 connected longitudinally thereto along the length of fold 36. Trapezoidal outer flip top walls 30 and 31 are disposed laterally from said front panel 29, so that in folded configuration the inner surface of said trapezoidal outer flip top walls 30 and 31 are in surface engagement with the outer surface of said trapezoidal side flaps 17 and 18; and the reinforcement tabs 25 and 28 are in sealed engagement with the undersurface of said top panel 23.

Figure 3A:
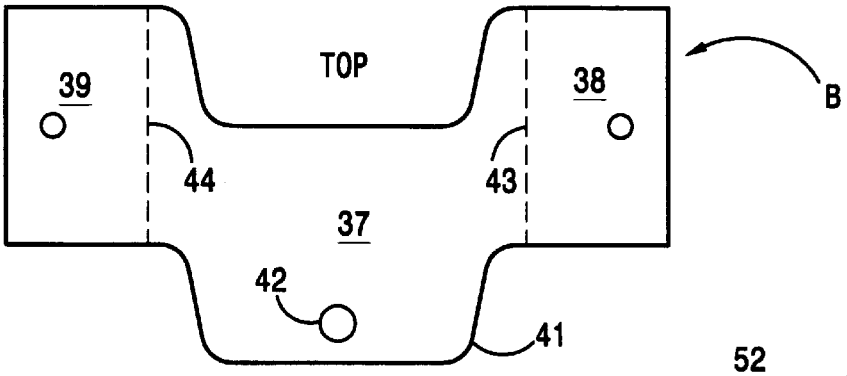
FIG. 3A is a plan view of a blank for an inner insert.

Another conventional component of the cigarette container is depicted in FIG. 3A. The inner liner insert B shown in FIG. 3A includes a front panel body 37 and lateral flaps 38 and 39. The top edge 40 of the insert B is recessed, and the bottom edge 41 is downwardly elongated. The front panel body 37 is defined by the top 40 and bottom 41 edges, and laterally by the folds 43 and 44. In operation the inner liner insert is inserted frontally into the outer envelope. The outer surface of the front panel body 37 engages the inner surface of the front panel 11 of the outer envelope, and the lateral flaps 38 and 39, folded at right angles along the folds 43 and 44 engage the lateral flaps 8 and 9 of the outer envelope portion with the highest elevation of the upper edge 40 of the front panel body 37 lying flush to the upper edge 12*b* formed upon folding the front panel 11 upwardly to its vertical position (See FIG. 4)

Figure 3B:
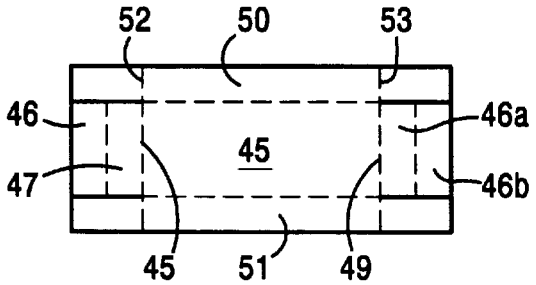
FIG. 3B is a plan view of a blank for a match drawer.

The final conventional component of the cigarette container is the drawer body itself depicted in FIG. 3B. FIG. 3B is a plan view of a match drawer having a bottom panel 45 elongated at each end by two tongues 46 and 47, and 46*b* and 46*b* at each end respectively, and folds 48 and 49 defining said bottom panel 45. The bottom panel 45 is joined at each fold 48 and 49 by lateral panels 50 and 51, which form the sides of the drawer body. In folded condition, the folds 52 and 53 are disposed at right angles and the tongue pairs at each end are sealed to secure the drawer body.

Figure 2:
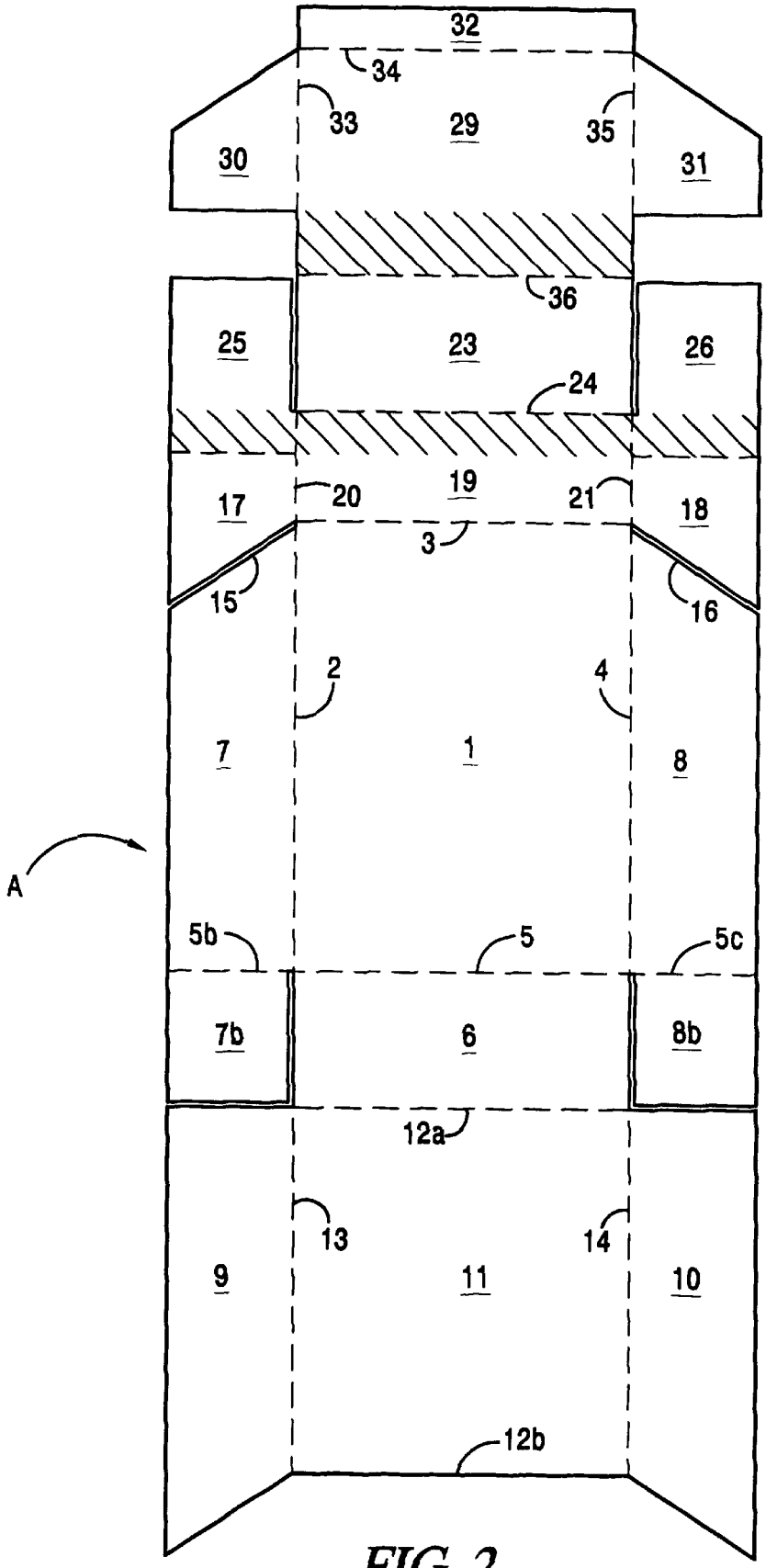
FIG. 2 is a plan view of a blank for an outer envelope portion of a cigarette container according to the present invention in one embodiment.

Referring to FIG. 2, the shaded portions thereof illustrating an outer envelope A of the invention depict an upper flip top portion having an elongated back panel 19 and a corresponding elongated front panel 29. As shown in FIG. 2, he reinforcement tabs 25 and 26 are elongated, to the same extent as the back panel 23 so that when folded according to the fold 24, they now join to form the floor portion of the drawer cavity 47 shown in FIG. 4. Any drawer that will accommodate at least twenty stick-type matches will have a corresponding cavity depth resulting in elongation of the reinforcement tabs sufficient to effect joinder thereof to form the said floor portion of the cavity. The crucial spacial relationship in the present invention is that the vertical height of the back panel 23, and the corresponding length of the reinforcement tabs 25 and 26, are greater than one half of the width of the cigarette container, so that the reinforcement tabs are joinable to form the floor portion of the drawer cavity.

Figure 4:
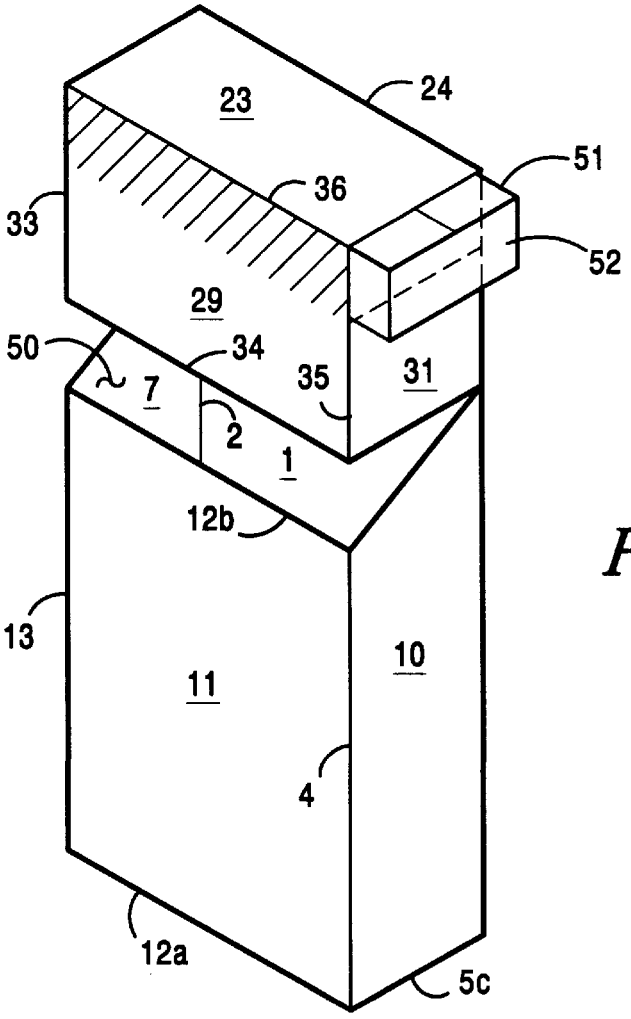
FIG. 4 is a perspective view of a cigarette container showing an assembled partially open flip top lid and a partially open match drawer therein.

FIG. 4 illustrates the folded relationship of key elements of the planar template. When folded along the folds 13, 12*a*, 4, 5*c* (and 5, 5*b* not shown), the frontal lateral flaps 9 and 10 engage the surface of the rear lateral flaps 7 and 8. Lower reinforcing flaps 7*b* and 8*b*, when folded at right angles (folds 5*b* not shown, and 5*c*) and rotated vertically through 90 degrees, engage the bottom panel 6. Engagement surfaces are sealed by fastening or sealing means, preferably glue. The folded and sealed lower cigarette portion thus defines a cigarette holding cavity 50.

FIG. 4 further illustrates the upper flip top portion of the cigarette container. The fold 3 (not shown) is a hinge allowing upward and downward movement of the flip top portion. At the angularity of the fold 3 in maximum extension, the container is closed and the edge 34 of the upper flip top portion engages edge 12*b* of the cigarette holding portion. The inverted trapezoidal outer flip top walls 30 and 31 engage the trapezoidal edges of lower lateral flaps 9 and 10. The elongated front panel 29 of the invention is clearly shown as the shaded portion. At the rear side of the upper flip top portion, there if a similar elongated portion (not shown).

The two elongated portions and the top panel 23, together with the joined elongated reinforcement tabs 26 and 26, thereby define the drawer cavity 51 of the present invention drawer, into which is inserted a drawer. Since both sides of the drawer cavity are open, the drawer may be opened from either side, thus making match removal equally convenient for the left- or right-handed user. Frictional retention of the drawer within the drawer cavity is facilitated by coating onto one or both sides of the drawer a striker material containing abrasive fines capable of igniting a match drawn against it.

What is claimed is:

1. An improved industry standard cigarette container having a standard four sided outer envelope portion, an inner liner insert, and an improved flip top lid portion, said improved lid portion comprising a match drawer cavity formed from an elongated front panel, an elongated back panel, and reinforcement tabs lateral to said elongated rear panel, said lateral reinforcement tabs being of a length greater than one half the width of said cigarette container to form a match drawer cavity floor; and a lower flip top lid portion comprising a pair of lower trapezoidal lateral flaps having outer surfaces and a back panel interposed therebetween, and a pair of trapezoidal lateral front flaps planarly vertical to said match drawer cavity whose inner surfaces engage the outer surfaces of said lower trapezoidal lateral flaps to form an integral flip top lid having a match drawer cavity sleeve integrated into the industry standard flip top lid.

2. The cigarette container of claim 1 together with a substantially rectangular, open topped drawer inserted into said improved lid match drawer cavity sleeve.

3. An improved cigarette container having a four sided outer envelope portion comprised from a single blank of material, a single inner liner insert, and a flip top lid portion comprising an outer envelope of integral construction forming both a lower cigarette containing portion, and an upper flip top portion including a match drawer cavity sleeve, said integral envelope comprising folding domains in which horizontal and vertical folds define said folding domains comprising a first folding domain characterized in having a pair of lateral flaps and a front panel portion disposed therebetween, said lateral flaps being capable of folding forwardly at right angles to said front panel in a vertical orientation, a bottom panel reinforced by lateral reinforcement tabs in a horizontal folding orientation to said front panel, and capable of folding at right angles, a back panel having two lateral trapezoidal flaps disposed to the left and right thereof and capable of folding vertically at right angles, the folded structure of said first folding domain forming the said cigarette containing portion of said container a second folding domain characterized in having a horizontal hinge fold connecting said cigarette containing folding domain and said upper flip top portion, lateral trapezoidal flaps disposed laterally to a elongated flip top back portion, said trapezoidal flaps being separated at a pair of horizontal folds into a lower trapezoidal lip portion and an upper reinforcement tab portion capable of folding horizontally downward at right angles, and simultaneously outward vertically at right angles to form a floor portion of said match drawer cavity sleeve, the elongated back portion capable of folding forward at right angles to form the top of the flip top and roof portion of said drawer cavity, and a further elongated segment extending downward from a horizontal fold terminating in an end portion of said front panel having lateral trapezoidal flaps, whose inner surfaces meet in mating engagement with the outer trapezoidal surfaces of said lateral trapezoidal flaps disposed lateral to said elongated flip top back portion.

* * * * *